US007420108B1

(12) United States Patent
Block

(10) Patent No.: US 7,420,108 B1
(45) Date of Patent: Sep. 2, 2008

(54) GUITAR LAP-STRAP

(76) Inventor: Sanford Lee Block, 459 Red Oak La., Highland Park, IL (US) 60035

( * ) Notice: Subject to any disclaimer, the term of this patent is extended or adjusted under 35 U.S.C. 154(b) by 93 days.

(21) Appl. No.: 11/324,825

(22) Filed: Jan. 4, 2006

(51) Int. Cl.
*G10D 3/00* (2006.01)

(52) U.S. Cl. ..... 84/327

(58) Field of Classification Search ..... 84/327
See application file for complete search history.

(56) References Cited

U.S. PATENT DOCUMENTS

| | | | | | |
|---|---|---|---|---|---|
| 1,802,236 | A | * | 4/1931 | Carroll et al. | 84/327 |
| 2,069,436 | A | * | 2/1937 | Feldman | 84/327 |
| 2,338,816 | A | * | 1/1944 | Lockhart | 84/411 R |
| 2,814,229 | A | * | 11/1957 | Vaccaro et al. | 84/327 |
| 2,956,467 | A | * | 10/1960 | Toop | 84/267 |
| 2,990,745 | A | * | 7/1961 | Casavant | 84/421 |
| 3,955,461 | A | * | 5/1976 | Ivie | 84/327 |
| 3,979,993 | A | * | 9/1976 | Proctor | 84/327 |
| 4,213,369 | A | * | 7/1980 | Swartwout | 84/284 |
| 4,406,207 | A | * | 9/1983 | Criscione | 84/411 P |
| RE31,722 | E | * | 11/1984 | Steinberger | 84/327 |
| 4,648,603 | A | * | 3/1987 | Hayford, Jr. | 273/148 B |
| 4,821,932 | A | * | 4/1989 | Petryshyn | 224/222 |
| 4,966,062 | A | * | 10/1990 | Driggers et al. | 84/327 |
| 5,388,492 | A | * | 2/1995 | Olson | 84/327 |
| 5,607,091 | A | * | 3/1997 | Musacchia | 224/222 |
| 5,616,874 | A | * | 4/1997 | Kraus et al. | 84/327 |
| 5,817,961 | A | * | 10/1998 | Beck | 84/327 |
| D410,669 | S | * | 6/1999 | Hamre | D17/20 |
| 5,988,469 | A | * | 11/1999 | Musacchia | 224/267 |
| 6,576,823 | B1 | * | 6/2003 | Wise, Jr. | 84/327 |
| 6,624,346 | B2 | * | 9/2003 | Standish | 84/280 |
| 6,805,608 | B2 | * | 10/2004 | Forbes et al. | 446/397 |
| 6,955,582 | B1 | * | 10/2005 | Forbes et al. | 446/397 |
| 2003/0217635 | A1 | * | 11/2003 | Christou | 84/327 |
| 2007/0193431 | A1 | * | 8/2007 | Sweeney | 84/327 |

* cited by examiner

*Primary Examiner*—Lincoln Donovan
*Assistant Examiner*—Robert W Horn

(57) ABSTRACT

The Guitar Lap-Strap is used to support a musical instrument, guitar or other portable musical instrument, while the instrument player is in a sitting or crouched position. The strap is designed to reduce the potential for downward or forward slippage of the instrument. The front playing surface of the guitar or instrument rests against the proximate or rear surface of the soft protrusion of the Guitar Lap-Strap, and requires no conforming to the instrument contour. The strap is adjustable and is secured around the individuals right or left mid-thigh utilizing a snap-lock buckle or other connector. A suede-like or cotton soft material protrusion called a retainer, is bound on the superior or front portion of the lap-trap which aids in preventing the downward or forward slippage of the instrument, and requires no conforming to the instrument contour. The Guitar Lap-Strap allows the user to support the hand held instrument without the use of a neck strap, foot rest, or other external instrument constraint, other than the players hands.

1 Claim, 9 Drawing Sheets

Guitar Lap-Strap

Guitar Lap-Strap

Mounted Front and Side View on the Right Thigh

Guitar Lap-Strap
Side-Closed View

The Lap-Strap connector can vary from a snap-lock buckle, hooks and loops, snaps, buttons, material string ties, or other connectors

Guitar Lap-Strap
Opened Top View

Strap Retainer Buckle

Strap width is approximately 1 inch, and has a variable length of 14 inches or greater Thigh Size Adjustment Loop Soft material protrusion retainer is approximately 7 inches in length and 1 inch in width and is sewn or fixed to the strap Strap Retainer Buckle right side

Guitar Lap-Strap

Proximate Side to Top View

Soft material protrusion retainer extending approximately 1 inch above the strap surface

Guitar Lap-Strap

Underside View of the soft material protrusion retainer

Fig. 8 Frictional (rubberized) material as shown in white, prevents slippage of the strap against the thigh

GUITAR LAP-STRAP

The utility of the Guitar Lap-Strap is to support a guitar or other portable musical instrument, while the instrument player is in a sitting or crouched position. The front playing surface of the instrument or guitar rests against the proximate or rear surface of the soft Guitar Lap-Strap protrusion which is comfortably belted or wrapped with the use of various self-contained connectors, around the individuals right or left mid-thigh. The soft non-marring material protrusion from the strap will aid in the support of the player instrument in the sitting or crouching position while the instrument is being grasped by the player. No conforming or placement of the guitar curve or contour on top of the soft protrusion is necessary. This allows the user the aid of supporting the hand held instrument without the use of a neck strap or other external constraint of the instrument other than the players hands. The Guitar Lap-Strap benefits the instrument player who uses a sitting position for playing an instrument in which the player utilizes the leg, thigh, or knee for support without the use of any other instrument restraint or foot support. In contrast, when playing the guitar in the sitting position without a restraint, the instrument may slip or move downward or forward off the players thigh, knee or leg. This forces the player to reposition the instrument while playing or at rest. The Guitar Lap-Strap when used properly can prevent or reduce instrument slippage.

1. The construction of the Guitar Lap Strap initially utilizes a strap made of leather, cotton, nylon, or other synthetic material, FIGS. 4, 5, and 6. The strap is approximately 1 inch wide and is constructed for adjustable sizing from 14 inches to 26 inches, FIG. 6. The strap will wrap around the mid-thigh, FIGS. 1A and 1B, indicating right and left sides respectively, 2A and 2B (FIG. 2A, showing the front mid-thigh position, and FIG. 2B showing seated position right side-view of the guitar resting against the rear surface of the blocking protrusion), and 3 (side view of the Guitar Lap-Strap and blocking protrusion), and is secured around the thigh by a connector which can vary from a snap-lock buckle, hooks and loops, snaps, buttons, material string ties, or other connectors, FIGS. 4, 5, and 6. At approximately 4 to 5 inches from the right hand end of the strap, FIG. 6, there will begin the retaining protrusion of soft suede-like or cotton material. This material should be selected so as not to unduly mar, abrade, rub, or wear on a musical instrument finish. The retaining soft suede-like or cotton protrusion, called a retainer, will initially be constructed from an approximately 7 inch by 3 inch in width of non-marring material. The soft material will initially be secured to the strap underside, sewn to place with thread or secured with an adhesive type or other anchoring material. The soft retainer material will then be brought over to the top side of the strap and a 6 inch by 1 inch piece or pieces of foam, cotton, or other soft filler material will be stuffed under the protrusion material, and secured into the top of the strap with thread or other anchoring material, FIGS. 7 and 9. The remaining excess material will be folded back to the undersurface of the strap and sewn into place, FIG. 8. The undersurface of the soft protrusion retainer will then receive an approximately 5 inch by ¾ inch piece of frictional or rubberized material which can be sewn, painted, or sprayed onto the underside, FIGS. 8 and 9. This frictional material will prevent the front of the strap from slippage during use.

2. The Guitar Lap-Strap will be adjusted on the mid-thigh to the proper length using the adjustment loop for the nylon or leather strap types, FIGS. 5 and 6. If the strap connector is either hooks and loops-type, buttons, snaps, ties or other, it will be adjusted accordingly. Care is taken to adjust the closed Guitar Lap-Strap to a comfortable fit on the instrument players mid-thigh, but not too tight, FIGS. 1A and 1B, 2A and 2B, and 3. The soft material protrusion retainer faces the front thigh position, and the strap's connector is positioned to the lateral side of the thigh for easier buckle access and release, FIG. 3.

3. When using the Guitar Lap-Strap, the front playing surface of the hand held instrument or the guitar will be positioned first on the thigh above and then against the proximate or rear surface of the soft Guitar Lap-Strap protrusion, and the remaining instrument secured by the players hands, FIG. 2B. No conforming of the soft protrusion to the guitar underside curve or contour is necessary. A name or logo can be imprinted on the front surface of the strap or on the soft protrusion retainer.

Figure 1A:
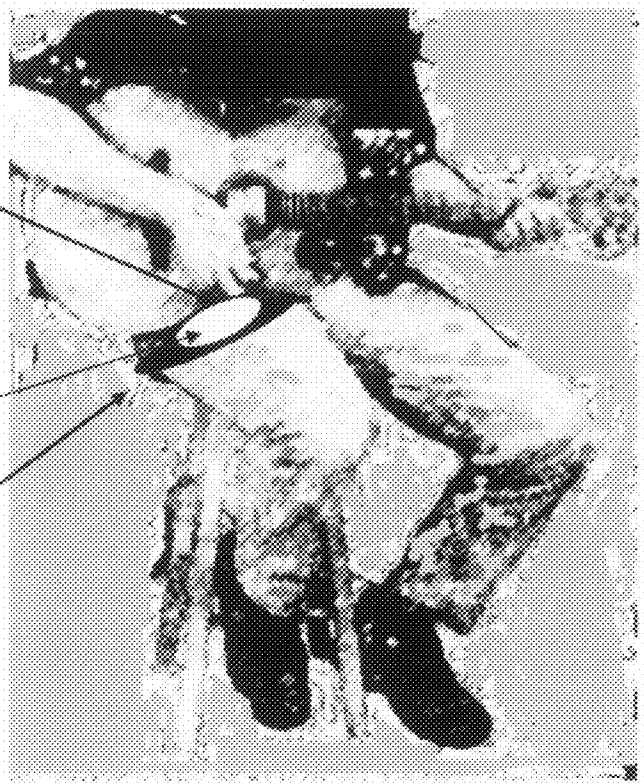
FIG. 1 is a perspective and representative view of the Guitar Lap-Strap mounted on the mid-thigh position of the right or left leg of the wearer.
Figure 1B:
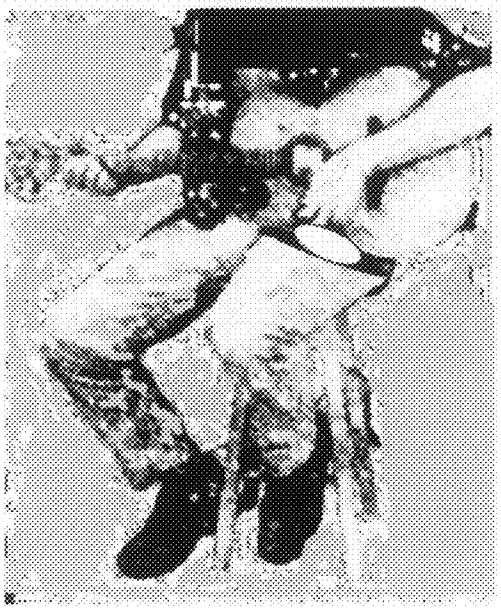
Figure 2A:
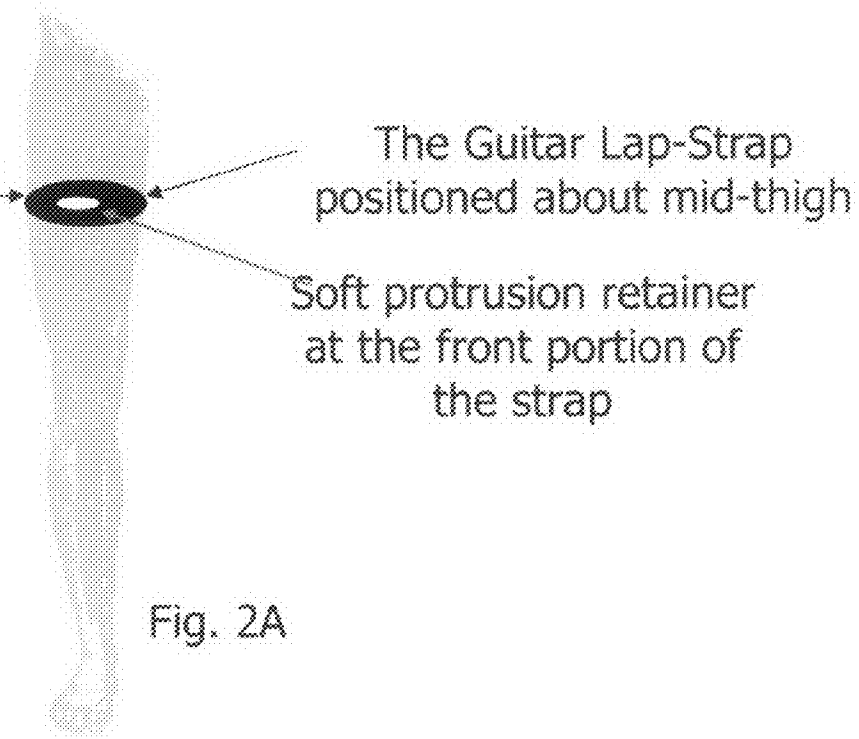
FIG. 2 is a mounted front view of the Guitar Lap-Strap at the mid-thigh position of the wearer.
Figure 2B:
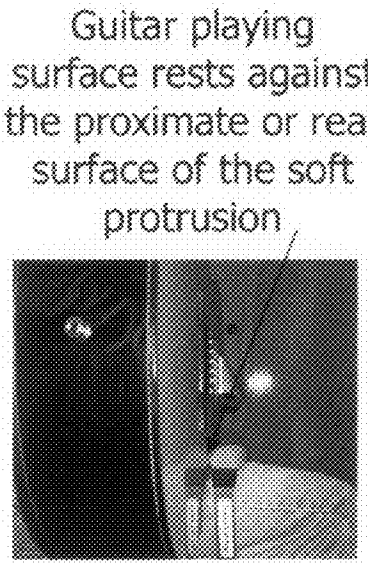
Figure 3:
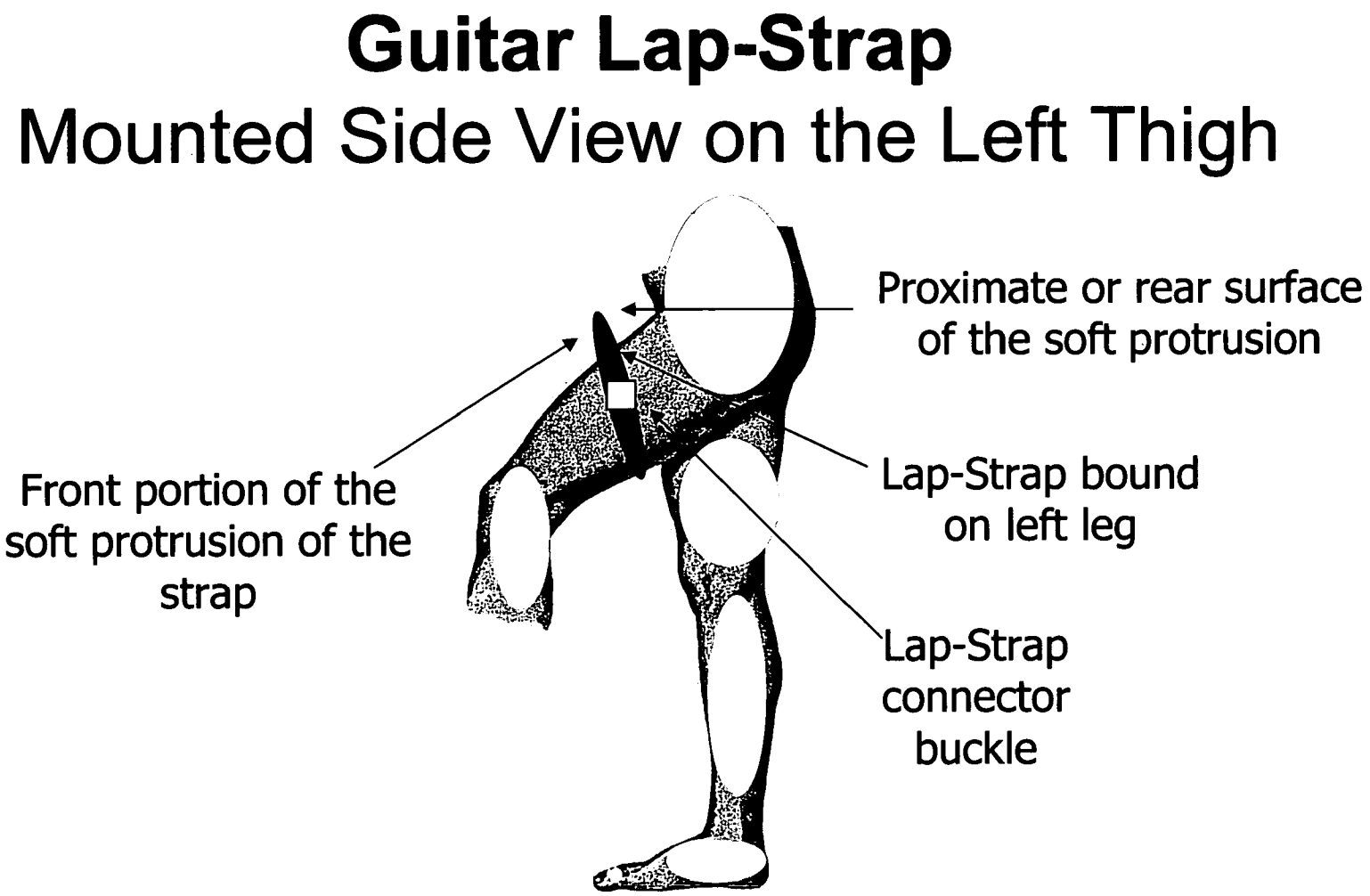
FIG. 3 is a drawing is a perspective side view of the Guitar Lap-Strap mounted on the left leg of the wearer.
Figure 4:
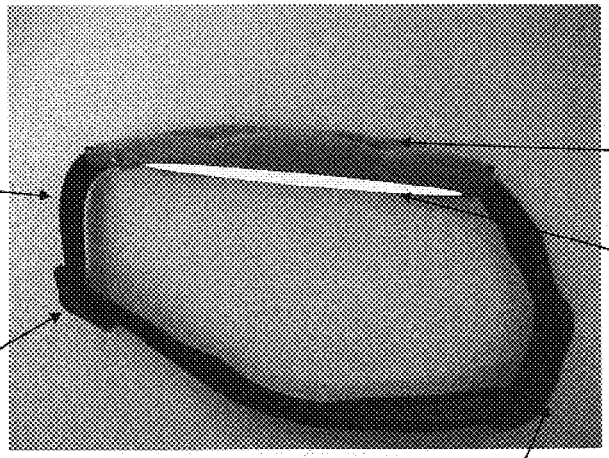
FIG. 4 is a unmounted side closed perspective view of the complete Guitar Lap-Strap which reveals the specific embodiments of the Guitar Lap-Strap.
Figure 5:
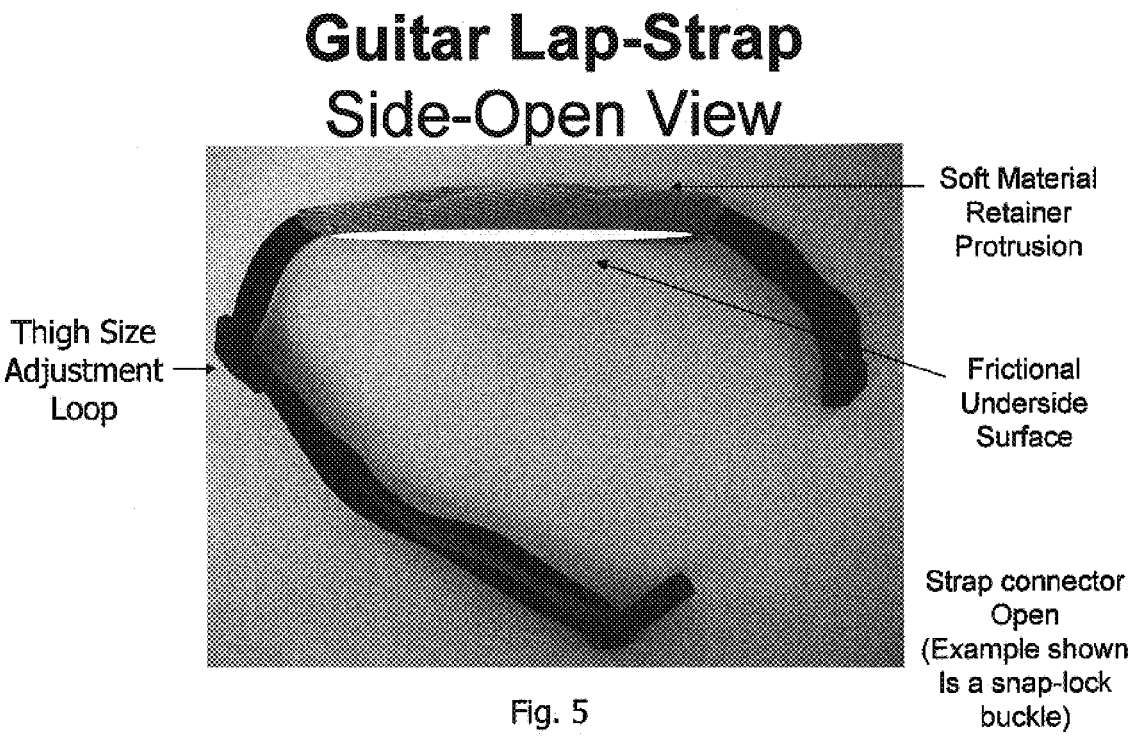
FIG. 5 is a unmounted side open perspective view of the complete Guitar Lap-Strap which reveals the specific embodiments of the Guitar Lap-Strap.
Figure 6:
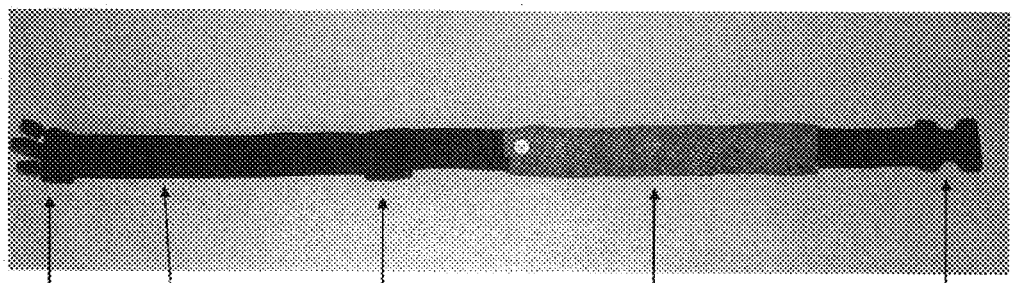
FIG. 6 is a unmounted open top or front view of the Guitar Lap-Strap revealing all the front embodiments of the Guitar Lap-Strap.
Figure 7:
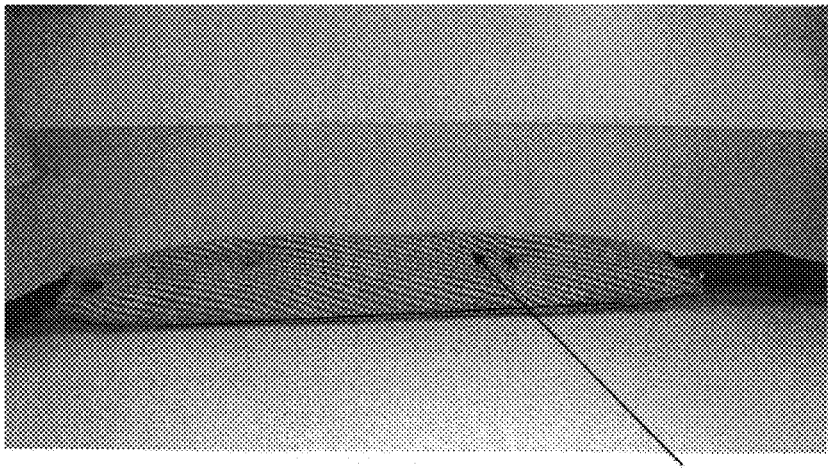
FIG. 7 is a side front elevational perspective of the Guitar Lap-Strap indicating the soft material protrusion from the strap.
Figure 8:
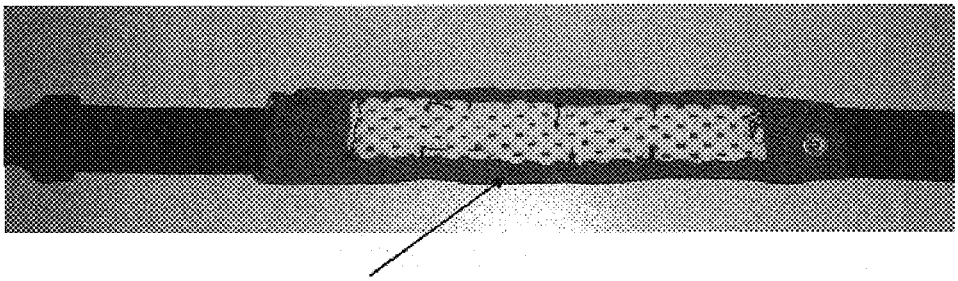
FIG. 8 is a underside perspective of the attachment of the soft material protrusion and the attached frictional component.
Figure 9:
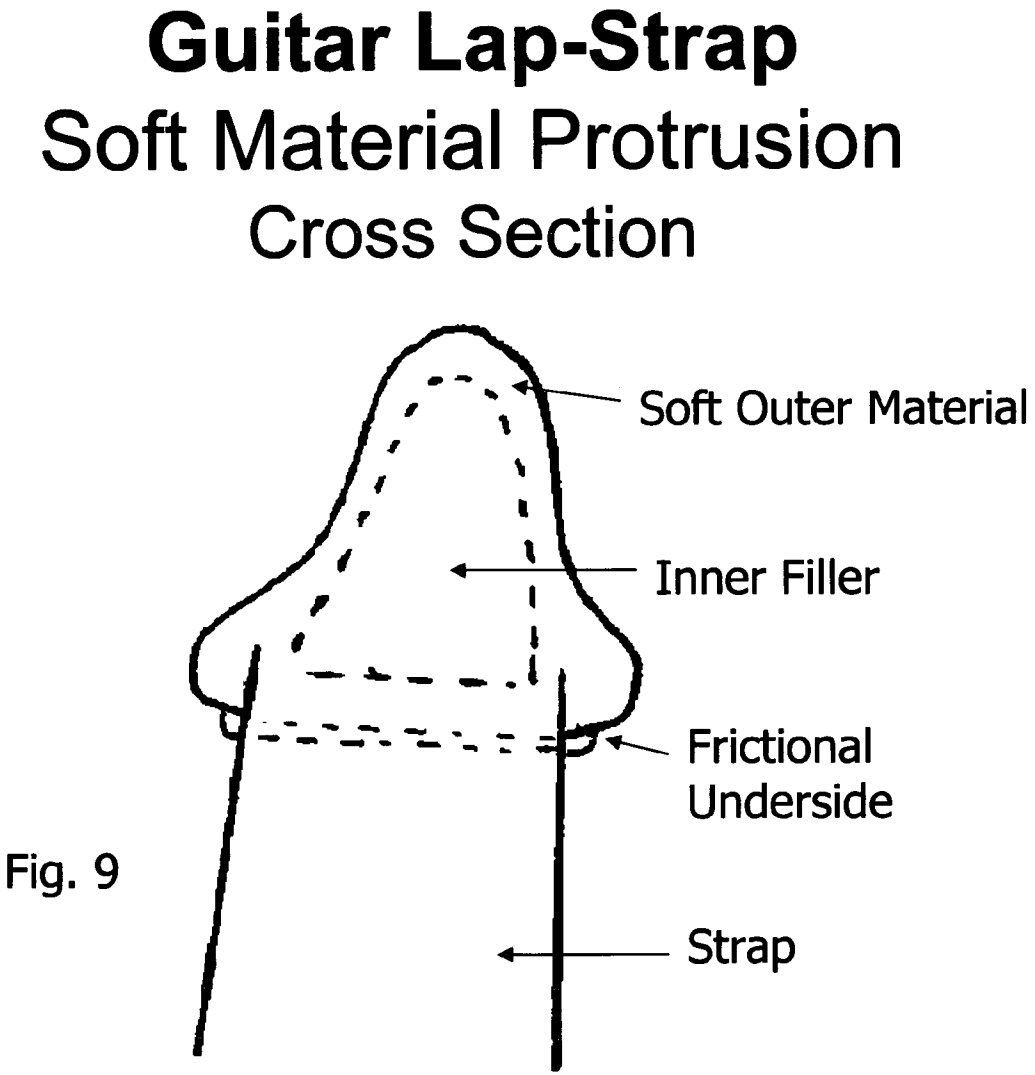
FIG. 9 is a vertical fragmentary cross section of the Guitar Lap-Strap embodiments at the attachment of the soft material protrusion viewed in FIGS. 7 and 8.

I claim:

1. A guitar lap-strap that supports a hand held musical instrument, guitar or other portable musical instrument, while the instrument player is in a sitting or crouched position, comprising:

a soft support positioned at the front playing surface of the instrument that blocks or reduces the potential for downward or forward slippage of the instrument off the supporting thigh;

the guitar lap-strap is an adjustable belt or wrap with a soft protrusion that is secured in a comfortable location utilizing various self-contained connectors, around the individuals right or left mid-thigh;

the attached protrusion is non-marring, comprising a soft material with an inner filler positioned on the superior or front portion of the lap-strap; and a frictional, rubberized underside surface of the strap below the protrusion that prevents the strap from sliding down the players leg;

wherein the hand held instrument or guitar is positioned on the thigh and the front playing surface of the instrument is placed against the rear surface of the soft guitar lap-strap protrusion, the protrusion forms a low ridge that does not interfere with the normal playing of the instrument in a sitting position when the instrument sits on the players leg behind the protrusion; and wherein the guitar lap-strap allows the user to support the hand held guitar or hand held instrument without having to conform to the instrument box contour or curve, and without the use of a neck strap, foot rest, or other external constraint, other than the players hands.

* * * * *